United States Patent [19]

Hayek

[11] 4,069,159

[45] Jan. 17, 1978

[54] ANTISTAT AND SOFTENER FOR TEXTILES

[75] Inventor: Mason Hayek, Wilmington, Del.

[73] Assignee: E. I. Du Pont de Nemours and Company, Wilmington, Del.

[21] Appl. No.: 654,279

[22] Filed: Feb. 2, 1976

[51] Int. Cl.[2] ..... D06M 13/46

[52] U.S. Cl. ..... 252/8.8; 8/115.5; 8/188; 252/8.6

[58] Field of Search ..... 252/8.8 AJ, 8.75, 8.6, 252/8.9; 8/115.5, 188; 260/124

[56] References Cited

U.S. PATENT DOCUMENTS

| | | | |
|---|---|---|---|
| 2,096,749 | 10/1937 | Kritchevsky | 260/404 |
| 2,717,842 | 9/1955 | Vitalis | 252/8.6 |
| 3,044,962 | 7/1962 | Brunt et al. | 252/8.75 |
| 3,423,314 | 1/1969 | Campbell | 252/8.6 |
| 3,515,580 | 6/1970 | Eastes | 252/8.6 |
| 3,773,463 | 11/1973 | Cohen et al. | 252/8.8 |
| 3,844,952 | 10/1974 | Booth | 252/8.75 |

OTHER PUBLICATIONS

Gregory, Uses & Appl. of Chemicals & Related Cpds., vol. II, 1944, p. 191.

*Primary Examiner*—William E. Schulz

[57] ABSTRACT

Described are antistatic and softener compositions for application to textiles consisting of (a) the reaction product of a member of the group consisting of alkylating, arylating and aralkylating agents and a condensation product of alkylolamine and carboxylic acid, the carboxylic acid containing at least twelve carbon atoms, e.g., the condensate of stearic acid and diethanolamine quaternized with dimethyl sulfate, and (b) an inorganic salt of an alkali or alkaline earth metal which improves the antistatic qualities of the composition and does not significantly impair the softening qualities thereof, e.g., lithium chloride.

3 Claims, No Drawings

ANTISTAT AND SOFTENER FOR TEXTILES

BACKGROUND OF THE INVENTION

1. Field of the Invention

This invention concerns a composition which, when applied to synthetic hydrophobic fabrics, diminishes their propensity to accumulate a charge of static electricity and softens the hand of the fabric.

2. Prior Art

Many types of chemical compounds have found use as antistatic agents on textiles. Quaternized amines containing at least one long aliphatic chain form one class recognized as useful.

Antistatic agents generally function by increasing the conductivity of the fabric surface, and most of them accomplish this by attracting moisture from the atmosphere, thus lowering the electrical resistance of the substrate. Kritchevsky, in U.S. Pat. No. 2,096,749, discloses a class of compounds formed by first condensing an alkylolamine and a carboxylic acid, then treating the condensate with an alkylating, arylating or aralkylating agent. These compounds were found to be good antistats and softening agents for synthetic fiber textiles. However, when exposed on fabrics to temperatures on the order of 205° C for 1 minute or more, they lose effectiveness. Temperatures of this order are sometimes used for heat setting polyester fabric. The problem is to provide an antistat or an additive to an antistat whereby the antistatic property of treated fabric will survive the heat-set temperature without adverse effect to the softened hand of the fabric.

Wells, in U.S. Pat. No. 3,594,222, discloses the use of lithium chloride as an antistatic agent in rubber latex compositions.

Henshall in "Antistatic Agents in the Textile Industry", Tinctoria, 52, 316–318 (1955) points out that chemicals such as calcium chloride and caustic soda, while hygroscopic, are quite unsuitable for application to textiles since they impart an objectionable hand, dust off, and render subsequent processing difficult.

SUMMARY OF THE INVENTION

The present invention is an antistatic and softener composition for application to textiles consisting of (a) the reaction product of a member of the group consisting of alkylating, arylating and aralkylating agents and a condensation product of alkylolamine and carboxylic acid, the component present in said condensation product being such that there is not substantially less than 2 moles of alkylolamine for each carboxyl group present in said acid, said carboxylic acid containing at least 12 carbon atoms, and (b) an inorganic salt of an alkali or alkaline earth metal which improves the antistatic qualities of the composition and does not significantly impair the softening qualities thereof, the composition containing from 0.1 to 1.0% of (a) and from 0.1 to 1.0% of (b). The preferred composition is that where (a) is a condensate of stearic acid and diethanolamine quaternized with dimethyl sulfate and (b) is lithium chloride and contains from 0.75 to 4 parts of (a) per part of (b).

DETAILED DESCRIPTION OF THE INVENTION

Addition of small amounts of certain inorganic salts to quaternized alkylolamine-carboxylic acid condensation products has been found to improve their performance as antistats on textiles. The condensates employed are those disclosed in Wolf Kritchevsky's U.S. Pat. 2,096,749. They are prepared by condensing a carboxylic acid containing at least 12 carbon atoms with an alkylolamine, using at least 2 moles of alkylolamine for each carboxyl group of the acid, then treating the condensate with an alkylating, arylating or aralkylating agent. An example is the product obtained by reacting one mole of stearic acid with 2 moles of monoethanolamine and treating the product with benzyl chloride. The condensation reaction is usually carried out at from 150° to 200° C or slightly higher.

The products are soluble in water in some cases, and form oleaginous masses in others. They can be applied to textiles from aqueous dispersion baths by padding, spraying or other commonly-used application methods. They normally achieve satisfactory softening and antistatic effect at 0.1 to 0.5% of the dry product on the fibers by weight. After application, the wetted fabric is dried at any selected temperature. For polyester fabrics the drying step can comprise a heat-setting treatment at a higher temperature, for example 205° C for 60 seconds or more.

It has now been found that when from about 0.1 to 0.5% of certain inorganic salts is deposited on the fabric along with the condensate, the antistatic effect of the treatment is significantly improved. Particularly with lithium chloride, the most preferred of these salts, the antistatic effect survives the heat treatment at 205° C much better than when the salt is absent. In addition to lithium chloride, other alkali and alkaline earth salts which improve antistatic qualities to a lesser degree include lithium bromide, lithium nitrate, cesium chloride and magnesium chloride.

In general, at least 0.1% of both condensate and salt are necessary to provide significant improvement in antistatic performance. An additional amount of condensate up to about 1.0% causes further improvement in the hand of the fabric, and improves antistatic performance slightly. An additional amount of one of the salts up to about 1.0% improves the antistatic performance, but tends to diminish the softness of the fabric. Lithium chloride is easily the best performer of the salt group since its use at the recommended level—0.1 to 1.0% on the weight of fabric along with a similar amount of condensate—provides both good antistatic properties and a satisfactory soft hand even after heat treatment for 90 seconds at 205° C.

Use of any of the salts in the absence of the condensate causes the hand of the fabric to become unacceptably harsh. While salt without condensate may provide a degree of antistatic effect, co-deposition of salt and condensate provides remarkable improvement.

The condensates of alkylolamines and aliphatic carboxylic acids are obtained by heating a mixture of the two containing a stoichiometric excess of the alkylolamine. Preferably an excess corresponding to more than 2 moles of a dialkanolamine for each mole of carboxylic acid is employed. A broad disclosure of these condensates and of methods for preparing them is found in U.S. Pat. No. 2,089,212. Examples of useful acids are stearic, palmitic, oleic, linoleic, lauric, myristic and ricinoleic acids, coconut oil fatty acid and also wax fatty acids of as high as 35 carbons. Useful alkylolamines are those of up to, e.g., six carbons and include ethanolamine, diethanolamine, triethanolamine, diethylethanolamine, butanolamine, pentanolamine, etc.

The exact nature of the condensation product is not known, and in fact several different products may be present. Further variation occurs when several different acids or alkylolamines are reacted together. The condensation is carried out at temperatures from 100° to 250° C, but preferably between 135° and 210° C. The most preferred condensate is formed by heating stearic acid and diethanolamine in the mol ratio 1/2.1 at temperatures up to 210° C.

Alkylation (including broadly arylation and aralkylation) of the condensates can be accomplished using agents such as dialkyl sulfates (dimethyl sulfate preferred), benzyl chloride, methyl iodide, methyl chloride, ethylene chlorohydrin and ethyl p-toluenesulfonate. The alkylation or arylation can be carried out at from room temperature up to about 125° C with about one mole or a slight excess of alkylating or arylating agent for each mole of carboxylic acid of the condensate.

The most preferred quaternized material (a) of the invention is prepared by heating the above-described 1 mole/2.1 mole stearic acid/diethanolamine condensate with 1.03 moles of dimethyl sulfate at about 90° C for about 2 hours. The reaction mass is drowned in water and the pH adjusted to about 7.0. The mass is diluted with water to the desired active ingredient proportion varying with the use intended. For storage purposes, 37.5—50% by weight, or even 25% by weight, may be desirable. An aqueous dispersion containing as low as 0.1% by weight of solids may actually be employed.

To prepare the improved composition of the invention, the solution of quaternized condensate can be heated to about 50° C and the salt dissolved therein with efficient agitation. The composition is then ready for use in textile treatment baths where it can be further diluted as desired for application to fabric.

Generally the composition is diluted with water to about 0.1 to 0.5% solids. The diluted composition can then be applied to fabrics at room temperature in any desired manner. Conveniently the fabric can be dipped into the bath, then wrung out to contain sufficient solution to provide the desired amount of solids on the fabric after drying. Thus, from a bath containing 0.5% total solids, if the fabric is dipped and wrung out to 100% pick-up (a weight of solution equal to the dry fabric weight), the fabric will contain 0.5% of composition solids after drying. Drying and curing can be performed at temperatures up to about 210° C.

The effects of the composition on fabric may be modified somewhat by the nature of the fabric itself. Thus, in order to achieve an acceptable level of softness or antistatic performance, one fabric may require a higher level of application than another. Economic considerations require that only enough additive be used to provide the desired effect. The treatment is most useful during the course of goods manufacture. The effects do not survive laundering, and the composition is therefore not intended for application to finished garments. Nylon, polyester and other synthetics benefit most from the treatment, but fabrics comprising a synthetic and a natural fiber, cotton for example, also can be improved. Curing conditions of time and temperature affect the performance of the compositions of the invention on fabrics.

There follow some examples illustrating the invention in detail. Unless otherwise specified, temperatures in these examples are in degrees centigrade and parts and percentages are given by weight unless otherwise indicated.

EXAMPLE 1

Tests with Lithium Chloride

Part A. Preparation of Quaternized Condensation Product of Diethanolamine and Stearic Acid Into a clean, dry reaction vessel was charged 12.74 parts by weight of diethanolamine. Nitrogen gas was bled into the vessel to replace air and exclude oxygen from the reaction. Temperature was adjusted to 120°-125°, and 0.055 part of 85% hydrazine hydrate aqueous solution was added to preserve a light color in the product. To the stirred diethanolamine was added 16.50 parts of molten stearic acid (120°-130°). With nitrogen gas bleeding very slowly, the kettle was evacuated to 400 mm Hg absolute pressure. The reaction mass was heated to 180° over 2½ hours. Water of reaction distilled from the vessel and was condensed and collected in a receiver. The charge was held at 400 mm Hg absolute pressure and 180° for ½ hour and then heated quickly (½ hour) to 200° and maintained at 200° for 1 hour. The charge was cooled to 100° and the vacuum released with nitrogen. Next, 0.0375 parts of sodium bisulfite was added to improve product color, and 0.31 part of N,N-dimethyl-stearylamine. Finally 7.52 parts of dimethyl sulfate was added to the condensation mass over 2.0 hours with the temperature at 95°, with a slow nitrogen bleed into the vessel throughout. After the dimethyl sulfate was added, the charge was stirred an additional hour, then drowned into 96.0 parts of distilled water at 58° with agitation. Temperature was held at below 70° during the drowning. The condensation kettle was rinsed out with 12.5 parts of water which was then added to the mass in the drowning kettle 1.09 Parts of diethanolamine was added to neutralize any acidity formed during the dimethyl sulfate quaterization reaction. The temperature was adjusted to 65° and agitation continued for ½ hour. The charge ws cooled to 52° and the pH adjusted to 7.0 ± 0.5 by adding a little more diethanolamine. If pH must be lowered, concentrated sulfuric acid may be added. Solids content of the product was 25.0%.

Part B. Preparation of Improved Antistat and Softener

Into a mixing vessel was charged 45.0 parts by weight of the 25% solids aqueous product of Part A. After heating to 50°, the liquid was agitated vigorously with high speed agitation and 9.0 parts of lithium chloride was added gradually over several hours. It was necessary to cool the mass to maintain temperature at between 60° and 70°. Agitation was continued for 1 hour after the lithium chloride addition. The product contained 16.7% lithium chloride and 20.8% of the stearic acid-diethanolamine condensation product.

Part C. Testing of Product for Antistatic Effect

The compositon of Part B was diluted with water to provide from about 0.1 to 0.5% of solids on treated textile material (about 0.1 - 0.5% in the water, also). The effects were compared with those of the unimproved product of Part A. Applications were made to dyed double knit fabrics of 100% polyester fiber. One fabric was dyed red, the other blue. The treated fabrics, after dipping and wringing as desired, were dried and cured for 30 seconds in some cases and 90 seconds in other cases at 204° C. Static tests were made using the AATCC Test Method 76-1975 for Electrical Resistivity of Fabrics (AATCC Technical Manual, pp. 199, 200

(1975)). The tests were performed at 20% relative humidity using a Keithley Model 610 C Electrometer obtained from Keithley Instruments Inc., 28775 Aurora Avenue, Cleveland, Ohio 44137. The value R, in ohms per square, was measured through fabric held between electrodes, and the value of Log R (base 10) selected. In these tests, values of Log R below 11.0 are regarded as satisfactory in antistatic performance.

The data are shown in Tables I and II below.

TABLE I

| Red Dyed Polyester Fabric | | Log R | |
|---|---|---|---|
| % Solids On Fabric From Aqueous Comp'n | % Salt on Fabric | 30 Sec. Cure at 204° | 90 Sec. Cure at 204° |
| None | Blank | 15.2 | 15.9 |
| 0.50 | — | 10.2 | 14.8 |
| 0.25 | — | 11.1 | 14.9 |
| 0.20 | Calcium Chloride 0.20 | 11.0 | 13.4 |
| 0.18 | Calcium Chloride 0.30 | 8.9 | 9.6 |
| 0.23 | Sodium Chloride 0.10 | 10.7 | 11.4 |
| 0.20 | Sodium Chloride 0.20 | 14.1 | 14.3 |

TABLE IV

| Blue Dyed Polyester Fabric | | Log R | |
|---|---|---|---|
| % Solids On Fabric From Aqueous Comp'n | % Salt on Fabric | 30 Sec. Cure at 204° | 90 Sec. Cure at 204 |
| None | Blank | 15.2 | 15.9 |
| 0.50 | — | 10.2 | 14.8 |
| 0.25 | — | 11.1 | 14.9 |
| 0.20 | Calcium Chloride 0.20 | 12.01 | 13.1 |
| 0.23 | Sodium Chloride 0.10 | 10.8 | 14.1 |
| 0.20 | Sodium Chloride 0.20 | 11.5 | 13.6 |

| % Solids on Fabric From Aqueous Comp'n | % Li Cl on Fabric | 30 Second Cure | 90 Second Cure |
|---|---|---|---|
| None | Blank | 15.2 | 15.9 |
| 0.50 | — | 10.2 | 14.8 |
| 0.25 | — | 11.1 | 14.9 |
| 0.21 | 0.17 | 9.2 | 9.4 |
| 0.16 | 0.13 | 9.0 | 11.1 |
| 0.10 | 0.08 | 9.5 | 11.3 |
| *0.23 | 0.08 | 9.9 | 12.3 |

*Extra Part A Comp'n added in this test.

TABLE II

| Blue Dyed Polyester Fabric | | Log R | |
|---|---|---|---|
| % Solids on Fabric from Aqueous Comp'n | % Li Cl on Fabric | 30 Second Cure | 90 Second Cure |
| None | Blank | 15.7 | 15.0 |
| 0.50 | — | 11.5 | 11.8 |
| 0.25 | — | 11.9 | 12.9 |
| 0.21 | 0.17 | 9.2 | 10.0 |
| 0.16 | 0.13 | 9.6 | 10.6 |
| 0.10 | 0.08 | 9.6 | 10.9 |
| *0.23 | 0.08 | 10.7 | 11.9 |

*Extra Part A Comp'n added in this test.

It can be seen that with an amount of lithium chloride lower than 0.1%, the antistatic effect is not quite up to the standard of Log R = 11.0 or less.

EXAMPLE 2

Tests with Salts Other Than Lithium Chloride

Treating solutions were prepared by diluting samples of the solution of Example 1, Part A, and adding sodium chloride in some cases and calcium chloride in others. Tests were performed as in Part C above on the same two fabric types. The data from static tests are shown in Tables III and IV below.

TABLE III

After the above tests, the treated and cured fabric samples were tested for crocking—undesired removal of dye from both dry and wet fabric—by rubbing with cotton cloth. While both lithium chloride and sodium chloride on the cloth had no effect in crocking the application containing calcium chloride caused significantly more crocking and would be very objectionable. Sodium chloride is unsatisfactory since the antistatic effect it provides diminishes as more of the salt is used.

EXAMPLE 3

Comparison of Antistatic Effect of Several Salts

A number of fabric-treating dispersions were prepared from the diluted Example 1, Part A, composition containing added salts. Samples of a dyed double-knit fabric of 100% polyester were padded with the dispersions and tested, with the results as shown in Table V below.

TABLE V

| % Solids on Fabric from Aqueous Comp'in | Salt, % on Fabric | | Log R 90 Sec. at 163° | 30 Sec. at 204° | 90 Sec. at 204° |
|---|---|---|---|---|---|
| None | Blank | | — | 14.6 | — |
| 0.25 | — | | 11.9 | — | 14.5 |
| 0.21 | Lithium Chloride | 0.17 | 8.6 | — | 11.1 |
| 0.20 | Lithium Bromide | 0.20 | — | 10.0 | 11.9 |
| 0.20 | Lithium Nitrate | 0.20 | — | 8.9 | 11.6 |
| 0.21 | Magnesium Chloride | 0.17 | 11.4 | 10.7 | 14.8 |
| 0.18 | Magnesium Chloride | 0.30 | 10.2 | 9.9 | 11.9 |
| 0.21 | Cesium Chloride | 0.17 | — | 10.8 | 14.4 |

TABLE V-continued

| % Solids on Fabric from Aqueous Comp'in | Salt, % on Fabric | | Log R 90 Sec. at 163° | 30 Sec. at 204° | 90 Sec. at 204° |
|---|---|---|---|---|---|
| 0.18 | Cesium Chloride | 0.30 | — | 10.5 | 14.0 |
| 0.20 | Sodium Chloride | 0.20 | 11.6 | 10.8 | 15.0 |
| 0.18 | Sodium Chloride | 0.30 | 12.3 | 10.8 | 14.8 |

While all of these salts improved the antistatic performance of the fabric to a degree, only the lithium salts preserved the good hand conferred by the Example 1 composition to a high degree. Particularly in the higher concentrations, the magnesium, cesium and sodium salt-treated fabrics were inferior in hand to those treated with the lithium salts.

I claim:

1. An antistatic agent for textiles comprising a mixture of:

a. a condensate of stearic acid and diethanolamine quaternized with dimethyl sulfate, and b. lithium chloride; the weight ratio of (a) and (b) being from 1.0/10 to 10/1.0.

2. The antistatic agent of claim 1 in the form of an aqueous dispersion of between about 0.1 and up to 50% by weight total solids.

3. The antistatic agent of claim 1 in the form of an aqueous dispersion containing about 37.5% by weight total solids.

* * * * *